US006508601B1

(12) United States Patent
Lui et al.

(10) Patent No.: US 6,508,601 B1
(45) Date of Patent: Jan. 21, 2003

(54) CHARGING CONTACT PLATE

(75) Inventors: Pui Kuong Lui, Kowloon (HK); Yiu Cheong Law, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 0 days.

(21) Appl. No.: 10/147,057

(22) Filed: May 17, 2002

(51) Int. Cl.[7] ..... B41J 29/00

(52) U.S. Cl. ..... 400/679; 361/221; 399/33; 399/90; 399/111

(58) Field of Search ..... 400/679; 361/221, 361/225; 399/168, 174, 176, 88, 89, 90, 111, 115, 33

(56) References Cited

U.S. PATENT DOCUMENTS 5,367,364 A * 11/1994 Michlin et al. ..... 361/221
5,737,664 A * 4/1998 Fukuda et al. ..... 399/33
5,768,660 A * 6/1998 Kurihara et al. ..... 399/111
5,790,927 A * 8/1998 Ando et al. ..... 399/176
6,064,841 A * 5/2000 Matsuzaki et al. ..... 399/90
6,374,071 B1 * 4/2002 Sato ..... 399/174

* cited by examiner

*Primary Examiner*—Andrew H. Hirshfeld
*Assistant Examiner*—Minh H. Chau
(74) *Attorney, Agent, or Firm*—Rosenberg, Klein & Lee

(57) ABSTRACT

A charging contact plate is used for preventing a primary charge roller of a cartridge used in a printer from shifting in a longitudinal direction and for charging the primary charge roller. The charging contact plate includes a main plate, a semicircle plate and a contact portion. The main plate has an end fastened on the cartridge and connected with a power supply within the printer. The semicircle plate has an end disposed at another end of the main plate. And, the contact portion has an end disposed at another end of the semicircle plate and has another end contacting with the primary charge roller.

7 Claims, 6 Drawing Sheets

CHARGING CONTACT PLATE

BACKGROUND OF THE INVENTION

1. Field of the Invention

The present invention relates to a charging contact plate, and more particularly, to a charging contact plate for preventing the shifting in the longitudinal direction of a primary charge roller of a cartridge used in a printer and for charging the primary charge roller.

2. Description of the Prior Art

Please refer to FIG. 1, which is a schematic diagram of a conventional charging device for charging a primary charge roller 8 of a cartridge used in a printer. The conventional charging device includes a charging contact point 8*a*, a metallic plate 8*b*, a coil spring 8*c* and a bearing 8*d*. The charge bias is applied from the charging contact point 8*a* to the primary charge roller 8.

The charging contact point 8*a* is a portion of the metallic plate 8*b* and connected with a power supply of the printer. The metallic plate 8*b* is contacted with one end the coil spring 8*c*. The bearing 8*d* is disposed at the other end of the coil spring 8*c*. And the bearing 8*d* serves to support the primary charge roller 8. Therefore, contact point 8*a*, a metallic plate 8*b*, a coil spring 8*c* and a bearing 8*d* form a conductive line for charging the primary charge roller 8.

However, since the conventional charging device is assembled by a number of portions, it is not a direct conductive line for connecting the primary charge roller 8 and the power supply of the printer, and it would result in the problems of electric conduction. The conventional charging device won't form a conductive line and can't charge the primary charge roller 8, when one portion of the conventional charging device doesn't contact the other portions properly.

Moreover, due to the conventional charging device being assembled by a number of portions, it would have large volume and be heavy, and there should be large room within the cartridge for containing it. Thus, the printer must be large and heavy, too. Therefore, this kind of design is inefficient and causes high cost.

Additionally, since the primary charge roller 8 may shift back and forth in the longitudinal direction as it rotates, it would hamper the image output quality of the printer. Further, this instability will cause the wear of the bearing 8*d* and the primary charge roller 8 and make the primary charge roller 8 more instable. Therefore, this kind of design has low image output quality.

SUMMARY OF THE INVENTION

It is an objective of the present invention to provide a charging contact plate for forming a direct conductive line for connecting the primary charge roller and the power supply of the printer. The charging contact plate is made integrally of a piece of elastically conductive material. It has two opposed ends for connecting the power supply of the printer and the primary charge roller, respectively. Therefore, it wouldn't have the problems of electric conduction.

Another objective of the present invention is to provide a charging contact plate for reducing the volume and weight of the printer. Since the charging contact plate is made integrally by a piece of elastically conductive material, it can be made to be a small and light one. Therefore, the printer can be made to be small and light, too.

The further objective of the present invention is to provide a charging contact plate for preventing the primary charge roller form shifting back and forth in the axial direction as it rotates. When one end of the charging contact plate is secured on the cartridge of the printer, the other end of the charging contact plate will press one end of the primary charge roller and force the primary charge roller to be stable by the elasticity of the charging contact plate.

These and other objectives of the present invention will no doubt become obvious to those of ordinary skill in the art after reading the following detailed description of the preferred embodiment illustrated in the various figures and drawings.

DETAILED DESCRIPTION OF THE PREFERRED EMBODIMENT

Figure 1:
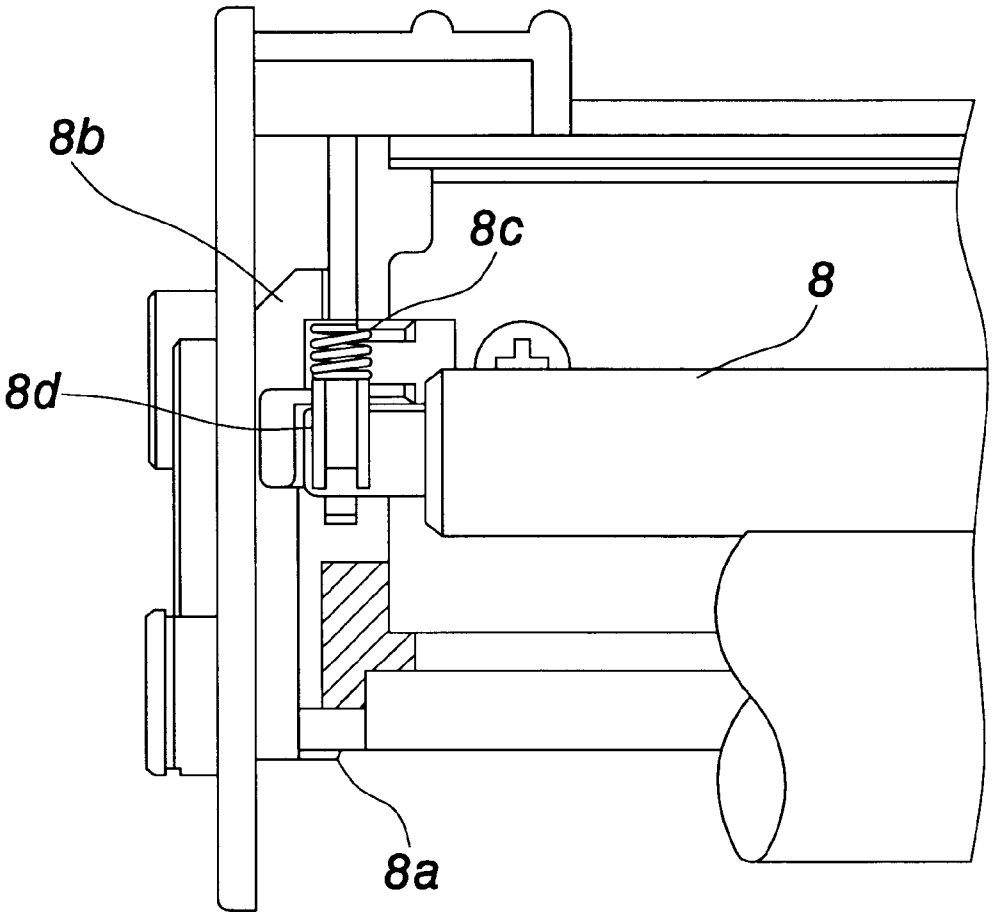
FIG. 1 PRIOR ART
FIG. 1 is a schematic diagram of a conventional charging device for charging a primary charge roller.
Figure 2:
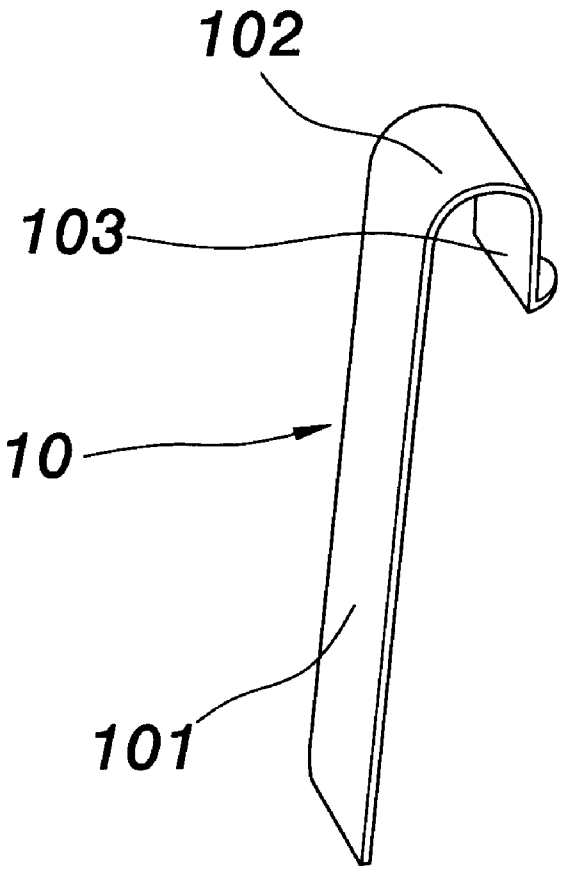
FIG. 2 is a schematic diagram of a charging contact plate according to the present invention.
Figure 3:
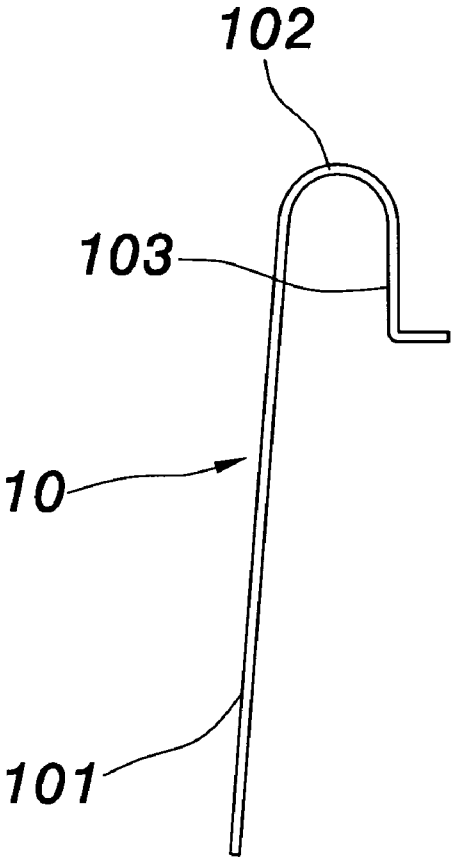
FIG. 3 is a front view of the charging contact plate in the present invention.
Figure 4:
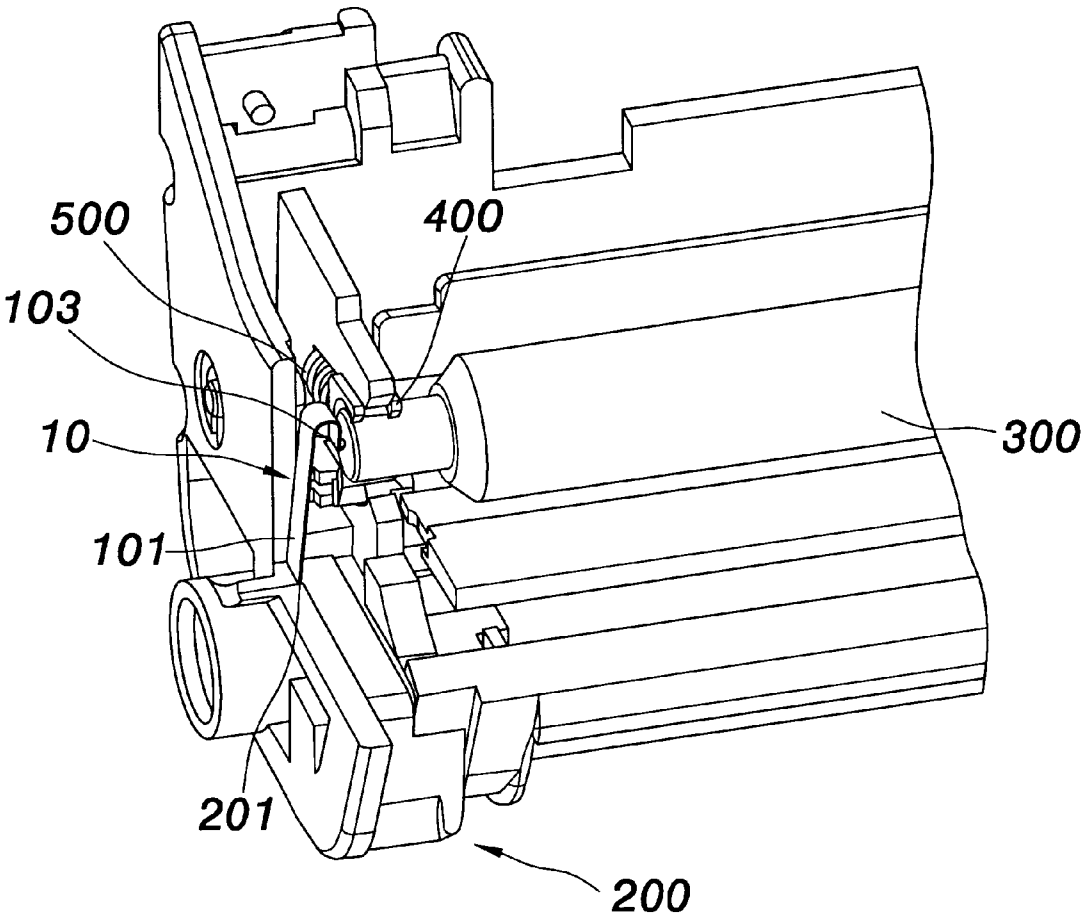
FIG. 4 is a schematic view of a cartridge employing the charging contact plate of the present invention.
Figure 5:
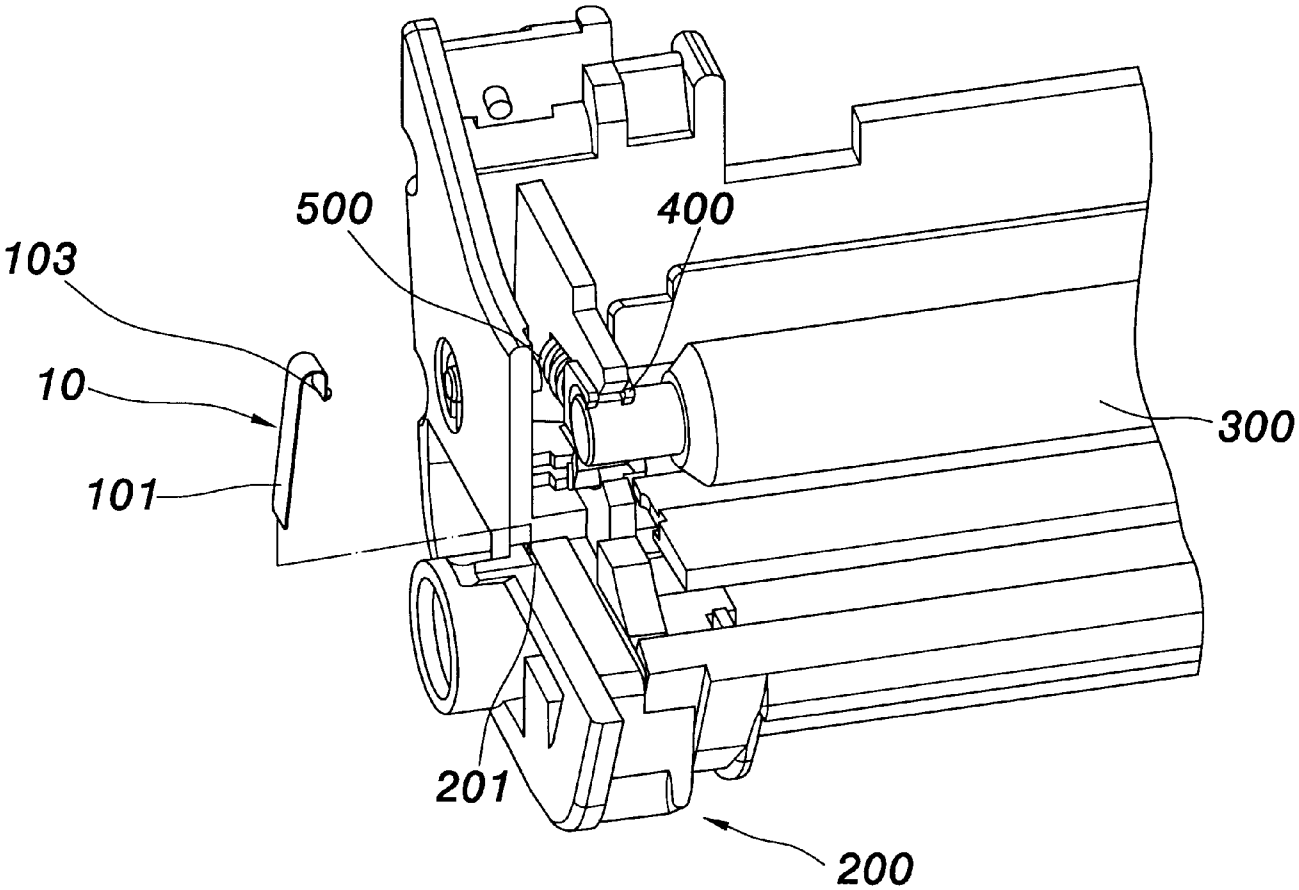
FIG. 5 is a decomposing view of the cartridge employing the charging contact plate of the present invention.
Figure 6:
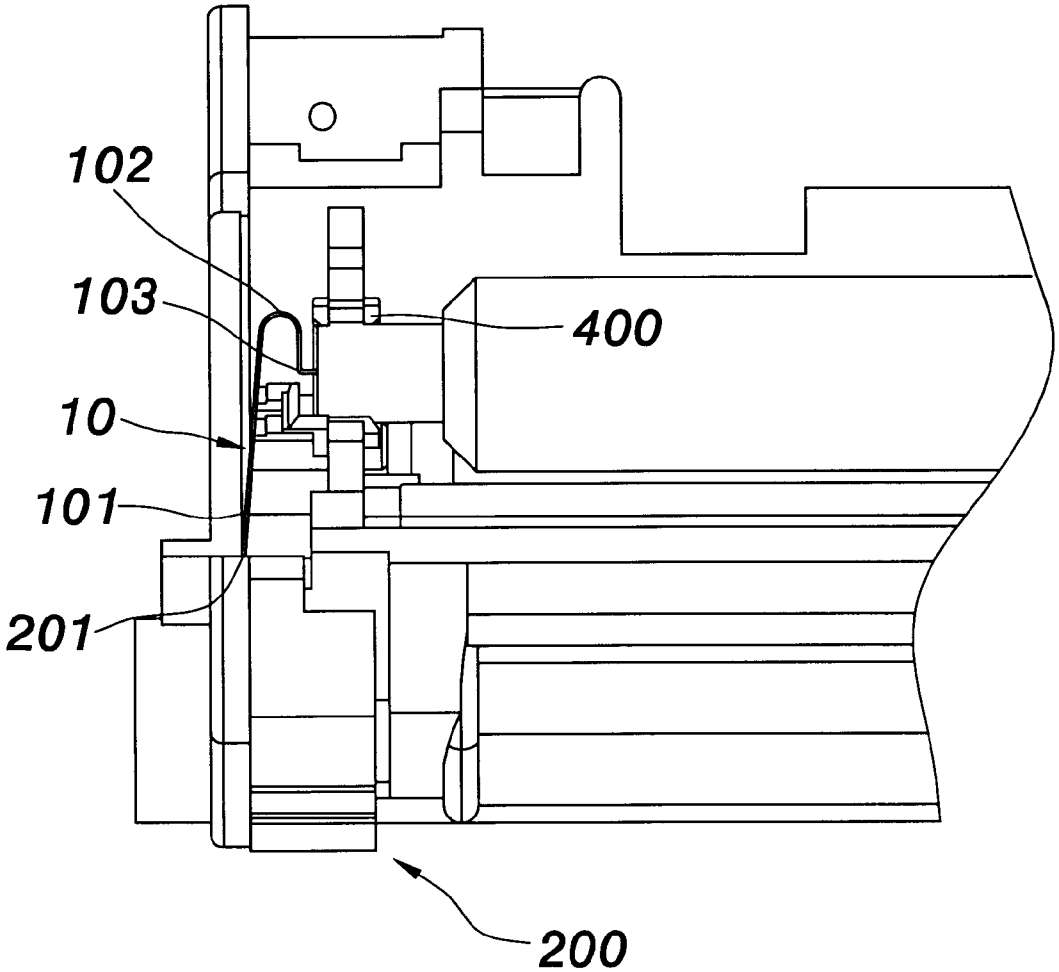
FIG. 6 is a front view of the cartridge employing the charging contact plate of the present invention.

Please refer to FIGS. 2~6 simultaneously. FIG. 2 is a schematic diagram of a charging contact plate 10 according to the present invention. FIG. 3 is a front view of the charging contact plate 10. And, FIG. 4 is a schematic view of a cartridge 200 employing the charging contact plate 10. FIG. 5 is a decomposing view of the cartridge 200 employing the charging contact plate 10. And, FIG. 6 is a front view of the cartridge 200 employing the charging contact plate 10.

The charging contact plate 10 includes a main plate 101 that has an end fastened on the cartridge 200 and connected with a power supply (not shown) of the printer; a semicircle plate 102 that has an end disposed at another end of the main plate 101; and a contact portion 103 that has an end disposed at another end of said semicircle plate 102 and has another end contacting with a primary charge roller (PCR) 300.

The main plate 101, the semicircle plate 102 and the contact portion 103 are formed to be an integral unit, i.e. the charging contact plate 10. The charging contact plate 10 is made integrally of a piece of elastically conductive material. The elastically conductive material can be a stainless steel or brass.

The contact portion 103 of the charging contact plate 10 is L-shape and contacts with the axial center of the primary charge roller 300 vertically. Moreover, there is a slot 201 formed within the cartridge 200 for clipping the main plate 101 of the charging contact plate 10. And, the main plate 101 is passed through the slot 201 to connect with the power supply (not shown) of the printer when the cartridge 200 is installed into the printer.

Further, the primary charge roller 300 of the cartridge 200 is supported by a bearing 400 disposed on one end of a supporting spring 500. The other end of the supporting spring 500 is disposed on the cartridge 200. And, the charging contact plate 10 should be disposed on the cartridge

200 such that charging contact plate 10 can electrically contact with one end of the primary charge roller 300 and press it by the elasticity of the charging contact plate 10 itself.

Therefore, the primary charge roller 300 can be charged by the power supply of the printer through the charging contact plate 10. And, the primary charge roller 300 also can be forced to be stable by the charging contact plate 10.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A charging contact plate for preventing a primary charge roller of a cartridge used in a printer from shifting in a longitudinal direction by a elasticity thereof and for charging said primary charge roller, comprising:

a main plate having an end fastened on the cartridge and connected with a power supply of the printer when the cartridge is installed into the printer;

a semicircle plate having an end disposed at another end of said main plate; and a contact portion having an end disposed at another end of said semicircle plate, and said contact portion having another end contacting with the primary charge roller;

wherein said main plate, said semicircle plate and said contact portion are formed to be an integral unit.

2. The charging contact plate of claim 1, wherein a material of the charging contact plate is a stainless steel.

3. The charging contact plate of claim 1, wherein a material of the charging contact plate is a brass.

4. The charging contact plate of claim 1, wherein a slot is formed within the cartridge for clipping the charging contact plate.

5. The charging contact plate of claim 1, wherein said contact portion is formed to be L-shape.

6. The charging contact plate of claim 1, wherein the another end of said contact portion contacts with an axial center of the primary charge roller.

7. The charging contact plate of claim 1, wherein the another end of said contact portion contacts with the primary charge roller vertically.

* * * * *